US005409298A

United States Patent [19]

Dickerson et al.

[11] Patent Number: 5,409,298

[45] Date of Patent: Apr. 25, 1995

[54] OPEN CUT MINING APPARATUS

[75] Inventors: Alan W. Dickerson, Mt. Eliza; Viet K. L. Mai, Glen Waverley, both of Australia

[73] Assignee: BHP Australia Coal Limited, Brisbane, Australia

[21] Appl. No.: 126,214

[22] Filed: Sep. 14, 1993

[30] Foreign Application Priority Data

Sep. 16, 1992 [AU] Australia ..... PL4771

[51] Int. Cl.[6] ..... F02F 3/48; F02F 3/64

[52] U.S. Cl. ..... 299/36; 37/394; 299/19

[58] Field of Search ..... 37/304, 394, 400, 401; 299/18, 19, 36

[56] References Cited

U.S. PATENT DOCUMENTS

| | | | |
|---|---|---|---|
| 1,999,775 | 4/1935 | Neil | 37/400 |
| 2,013,276 | 9/1935 | Luce | 37/394 |
| 2,864,182 | 12/1958 | Russell | 37/394 |

FOREIGN PATENT DOCUMENTS

| | | |
|---|---|---|
| 18277 | 2/1929 | Australia . |
| 63540/86 | 8/1988 | Australia . |
| 845330 | of 0000 | Germany . |
| 569610 | 1/1933 | Germany . |
| 941362 | 3/1956 | Germany . |
| 1578006 | 10/1980 | United Kingdom . |

OTHER PUBLICATIONS

Sauerman Tower Excavators, pp. 2–11, no publication date.

*Primary Examiner*—David J. Bagnell

*Attorney, Agent, or Firm*—Nikaido, Marmelstein, Murray & Oram

[57] ABSTRACT

An apparatus for removing overburden or for mining a mineral from a valuable mineral or coal deposit, such as in an open pit mine, is disclosed. The apparatus comprises a cross-pit vehicle which is adapted to move between the high wall and low wall sides of the pit and, as it moves across the pit floor, to cut overburden from the pit floor and to carry the dislodged overburden to the low wall side of the pit. The apparatus further comprises a winch assembly on the low wall side of the pit and a cable which connects the low wall winch assembly to the cross-pit vehicle. The apparatus further comprises a winch assembly on the high wall side of the pit and a cable which connects the high wall winch assembly to the cross-pit vehicle. The low wall winch assembly is adapted to move the cross-pit vehicle from the high wall side towards the low wall side and the high wall winch assembly is adapted to return the cross-pit vehicle to the low wall side.

16 Claims, 4 Drawing Sheets

19
11
11
15
LOW WALL SIDE
21
9
9
17
17
PIT
7
17
17
9
9
HIGHWALL SIDE
13
11
11

OPEN CUT MINING APPARATUS

The present invention relates to an apparatus for removing overburden or for mining a mineral from a valuable mineral or coal deposit such as a coal seam.

In strip type open cut coal mines such as those in the Bowen Basin of Queensland and other regions of the world, draglines are widely used and are a very cost effective means of removing the overburden above seams of coal for depths up to about 50 meters. As mining progresses to greater depths, the cost of removing the overburden from above the coal increases quickly because the distance over which much of the overburden has to be moved is greater than can be achieved with a single sequence of the dragline operation. Consequently, increasing amounts of the overburden must be excavated and placed in one position by the dragline and then after re-positioning of the dragline, the material is re-excavated and placed into a second position. As the depth of the coal seam increases, increasing amounts of the overburden must be double handled and sometimes even triple handled by the dragline before it is in its final position in the mined-out section of the mine. The cost of removing overburden with draglines increases rapidly as the depth of the coal increases from about 50 to about 65 m and for most draglines the economically feasible mining depth does not exceed about 60 m.

Two mining systems that are commonly used to supplement draglines and allow economic recovery of deeper coal seams by open cut mining are excavator-loader plus truck systems and motorised tractor-scraper systems. Both these systems suffer the disadvantage of being relatively high cost systems and these costs severely limit the depth to which open cut coal mining can continue. A major reason for the high cost of these systems is that both involve long transport distances for the overburden material because neither trucks nor tractor-scrapers can negotiate the steep slopes that would be encountered in moving the overburden material by the shortest route which is directly across the pit. Actual transport distances can be 3 to 20 times the direct across the pit transport distance.

A range of mining systems based on the use of a hoe that scrapes and pushes and thereby transports overburden from a high wall side to a low wall side of a mine pit have been proposed. In these proposals, the hoe is drawn across the pit through the overburden by means of cables connected to winches on the high wall side and the low wall side of the pit. One example of such a system is described in Australian patent specification AU-B-63540/86 (Beatty). Whilst systems of this type move the overburden by the shortest practical path and also overcome the re-handle problem of draglines, all of the transport work is done against the resistance of shearing between the overburden entrained in the hoe and the overburden over which it is being moved. Consequently, the energy expenditure for the transport process is very high with the results that the productive capacity of a given sized machine is unacceptably low and such systems are not generally economically viable. Whilst there has only been limited experience with such systems, it is expected that the effectiveness of such systems will also be restrained by the limited control over the hoe loading and/or unloading processes that are inherent with such concepts.

It is an object of the present invention to provide an apparatus for removing overburden or for mining a mineral which alleviates the disadvantages of the known and proposed equipment discussed in the preceding paragraphs.

According to the present invention there is provided an apparatus for removing overburden or for mining minerals from a valuable deposit comprising:

(a) a cross-pit vehicle adapted to displace overburden or minerals as the cross-pit vehicle moves from a first location towards a second location and to carry the displaced overburden and/or minerals to the second location;

(b) a first anchoring point;

(c) a cable extending from the first anchoring point to the cross-pit vehicle; and (d) a winch assembly selectively operable for winding the cable to move the cross-pit vehicle from the first location to the second location.

The term "anchoring point" is understood herein to cover any suitable means of reacting against the forces required to move the cross-pit vehicle.

It is preferred that there be:

(a) a second anchoring point;

(b) a cable extending from the second anchoring point to the cross-pit vehicle; and (c) a winch assembly selectively operable for winding the cable to return the cross-pit vehicle, when empty, from the second location to the first location.

It is preferred that the first anchoring point be located on a low wall side of an open cut mine.

It is preferred that the second anchoring point be located on a high wall side of the open cut mine.

It is also noted that in some applications the second anchoring point on the high wall side of the pit may not be necessary because, for example, the empty cross-pit vehicle can return to the first location under the pull of its own weight.

Typically, the anchoring points comprise purpose designed machines and/or converted/modified draglines and/or bulldozers and/or electric rope shovels which are movable in a direction transverse to the direction of movement of the cross-pit vehicle to reposition the cross-pit vehicle to move progressively over an area to be mined.

The term "cable" is understood herein to describe any suitable form of cable, rope, or wire.

It is preferred that the cross-pit vehicle comprises, a cutting edge for dislodging overburden and/or minerals from the mine floor as the cross-pit vehicle is being pulled towards the low wall side anchoring point, and a bowl for receiving and carrying the dislodged overburden and/or minerals transferred into the bowl due to the forward motion of the bowl with or without loading assist mechanisms.

It is preferred particularly that the cross-pit vehicle be a wheeled vehicle.

It is preferred more particularly that the bowl be movable between an operative position at which the forward end of the bowl and its cutting edge extend into and displace the overburden and/or minerals on the mine floor into the bowl and an inoperative position at which the bowl and the cutting edge are clear of the overburden and/or minerals.

The winch assemblies may be located on the cross-pit vehicle and/or on the first and/or second anchoring points.

It is preferred that the apparatus further comprises a means to unload the overburden and/or minerals carried in the bowl at the second location.

The unloading means may be located on the cross-pit vehicle, the first anchoring point, or at any other suitable location.

When the winch assemblies are located on the cross-pit vehicle it is preferred that the apparatus further comprises an electrical power cable tower and an electrical cable extending between the tower and the cross-pit vehicle to supply power to the or each winch assembly.

It is preferred that the apparatus further comprises a control room located on the tower, on one of the anchoring points, or at any other suitable location.

The present invention is described further by way of example with reference to the accompanying drawings in which.

The preferred embodiments of the apparatus of the present invention are described hereinafter in the context of removing overburden from an open cut mine to expose a coal seam, although it is understood that the present invention is not limited to this application and extends generally to the removal of overburden from a valuable mineral deposit and/or to the removal of the valuable mineral deposit.

Figure 1:
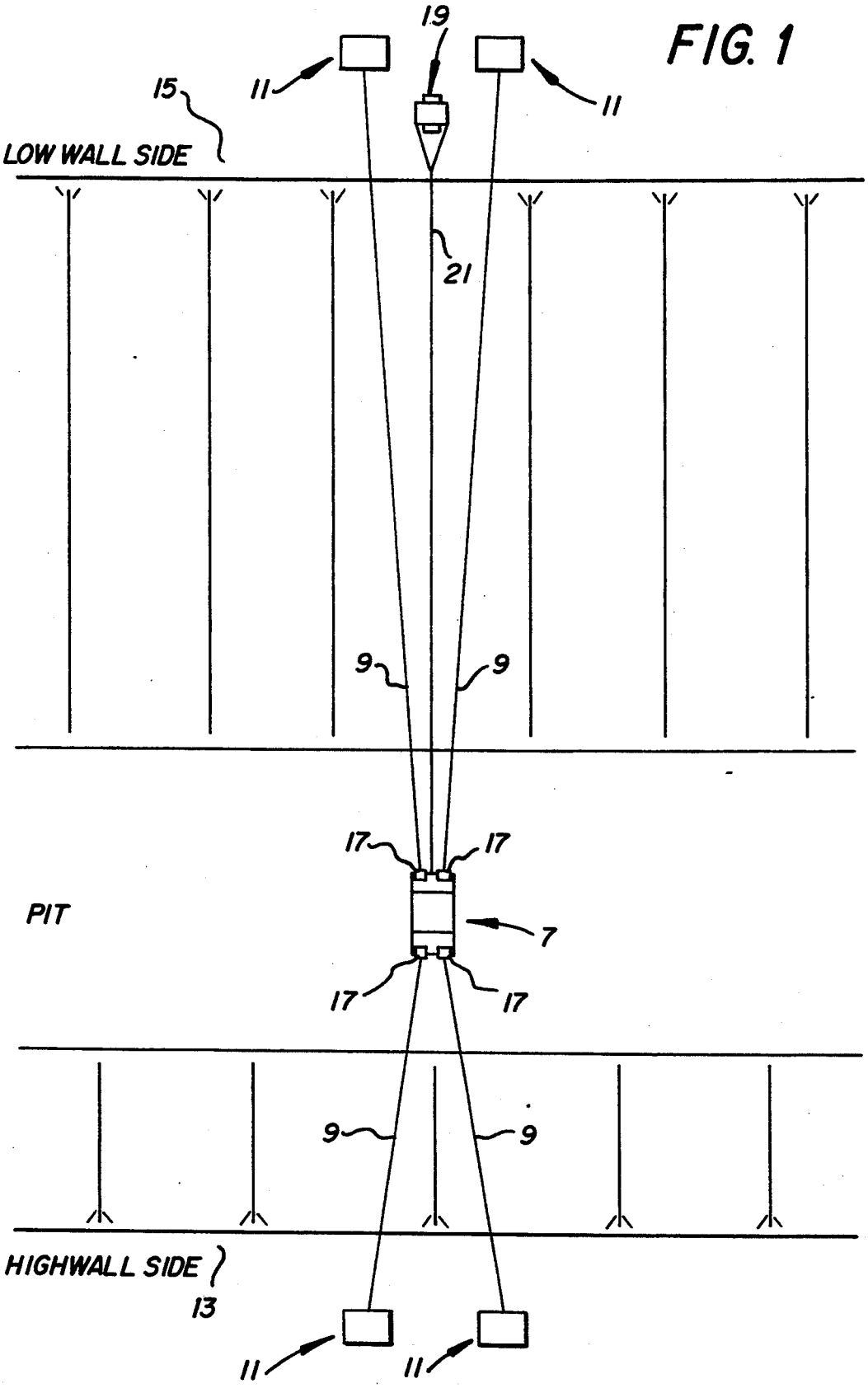
FIG. 1 is a plan view of one embodiment of an apparatus in accordance with the present invention arranged to remove overburden that covers a valuable mineral or coal deposit in an open-cut mine.

The preferred embodiment of the apparatus shown in FIG. 1 comprises a cross-pit vehicle 7 connected by cables 9 to pairs of anchoring points 11 on the high wall side 13 and the low wall side 15 of the mine.

The apparatus further comprises electrically powered winches 17 mounted on the cross-pit vehicle 7 and operable selectively to move the cross-pit vehicle 7 along the path between the anchoring points 11 to remove overburden from a section of the mine floor and to dump the overburden in a spoil pile thereby in effect to extend the low wall side 15.

The apparatus further comprises an electrical power cable tower 19 on the low wall side 15 and an electrical cable 21 suspended between the tower 19 and the cross-pit vehicle 7 to supply electrical power to the winches 17 and other mechanisms on the cross-pit vehicle 7. The tower 19 may be crawler mounted and provided with an automatic cable take-up and pay-out system to ensure a predetermined tension in the electrical cable 21. The winches 17 and other mechanisms on the cross-pit vehicle 7 may be supplied with electrical power by any other suitable means. By way of example, trailing cables could be provided.

The electrical power cable tower 19 also houses a control room (not shown) from which an operator can control the operation of the apparatus. The control room may be located at any other suitable location.

The cross-pit vehicle 7 may be any suitable wheeled vehicle which is adapted to displace overburden as it is moved along the path between the anchoring points 11 and to carry the displaced overburden to the spoil pile adjacent to the existing low wall side 15 and thereafter unload the overburden.

By way of example, the cross-pit vehicle 7 may be similar to a conventional tractor-scraper without power supplied to the wheels and thus may comprise, a cutting edge for dislodging overburden from the mine floor, a wheel supported bowl for receiving and retaining the dislodged overburden as the cross-pit vehicle 7 moves along the path, a means for lifting the cutting edge and the bowl clear of the ground, and a means for facilitating dumping the overburden from the bowl to form the new spoil pile adjacent the existing low wall side 15. As with the conventional tractor-scraper, in order to minimise friction and therefore energy requirements, the cutting edge and the bowl may be movable to a carry position at which the cutting edge, the bowl, and the retained load are clear of the mine floor when the bowl is full.

The anchoring points 11 on the high wall side 13 and the low wall side 15 may be of any suitable configuration. By way of example, the anchoring points 11 may be bulldozers, with or without anchoring spikes at the blade end and the back end, and/or converted draglines and/or converted electric rope shovels and/or purpose designed machines. It is noted that, in view of the relatively lower stability of the low wall side 15 compared with the high wall side 13, in some instances there may be a preference to use bulldozers on the low wall side 15 in order to minimise the weight on the low wall side 15.

The winches 17 may be of any suitable configuration. It is noted that, whilst all the winches 17 are located on the cross-pit vehicle 7 in the preferred embodiment shown in FIG. 1, the present invention is not restricted to such an arrangement and it is within the scope of the present invention to locate winches 17 on the anchoring points 11 on the high wall side 13 and/or the low wall side 15, or on the electrical power cable tower 19 or in various combinations. It is noted that, in view of the relatively lower stability of the low wall side 15 compared with the high wall side 13, there may be a preference in some instances to locate the "low wall" winches 17 on the cross-pit vehicle 7 in order to minimise the weight on the low wall side 15. In addition, the electrical power cable tower 19 may be located on the high wall side 13 to avoid supplying electrical power to the low wall side 13 of the mine.

In use of the apparatus shown in FIG. 1, the operator in the control room selectively operates the winches 17 to move an empty cross-pit vehicle 7, arranged so that the cutting blade faces the low wall side 15, towards the high wall side 13. When the cross-pit vehicle 7 is in the correct position, the operator stops the winches 17, lowers the cutting blade to the required location, and then operates the winches 17 to move the cross-pit vehicle 7 towards the low wall side 15. As a consequence, the cutting blade dislodges and loads material from a section of the mine floor into the bowl. It can readily be appreciated that the operator is well placed to monitor the progress of the cross-pit vehicle 7 over the mine floor and can adjust the angle of attack of the cutting blade as may be required to accommodate changes in terrain. When the bowl of the cross-pit vehicle 7 is full the operator raises the cutting blade clear of the mine floor. The cross-pit vehicle 7 may also incorporate a front door on the load carrying bowl which would also be closed at this stage. Finally, when the cross-pit vehicle 7 reaches a required location adjacent the low wall 15 the operator dumps the material from the bowl. This may involve lifting the front door on the load carrying bowl and operating an unloading mechanism inside the load carrying bowl (not shown). The unloading process may be performed with any other suitable means situated at the required location on the travel path of the cross-pit vehicle 7. The above described procedure is repeated until all the overburden to be moved has been moved from a particular section of the mine. The anchoring points 11 and the electrical power cable tower 19 are then repositioned successively to move material from other sections of the mine.

Figure 2:
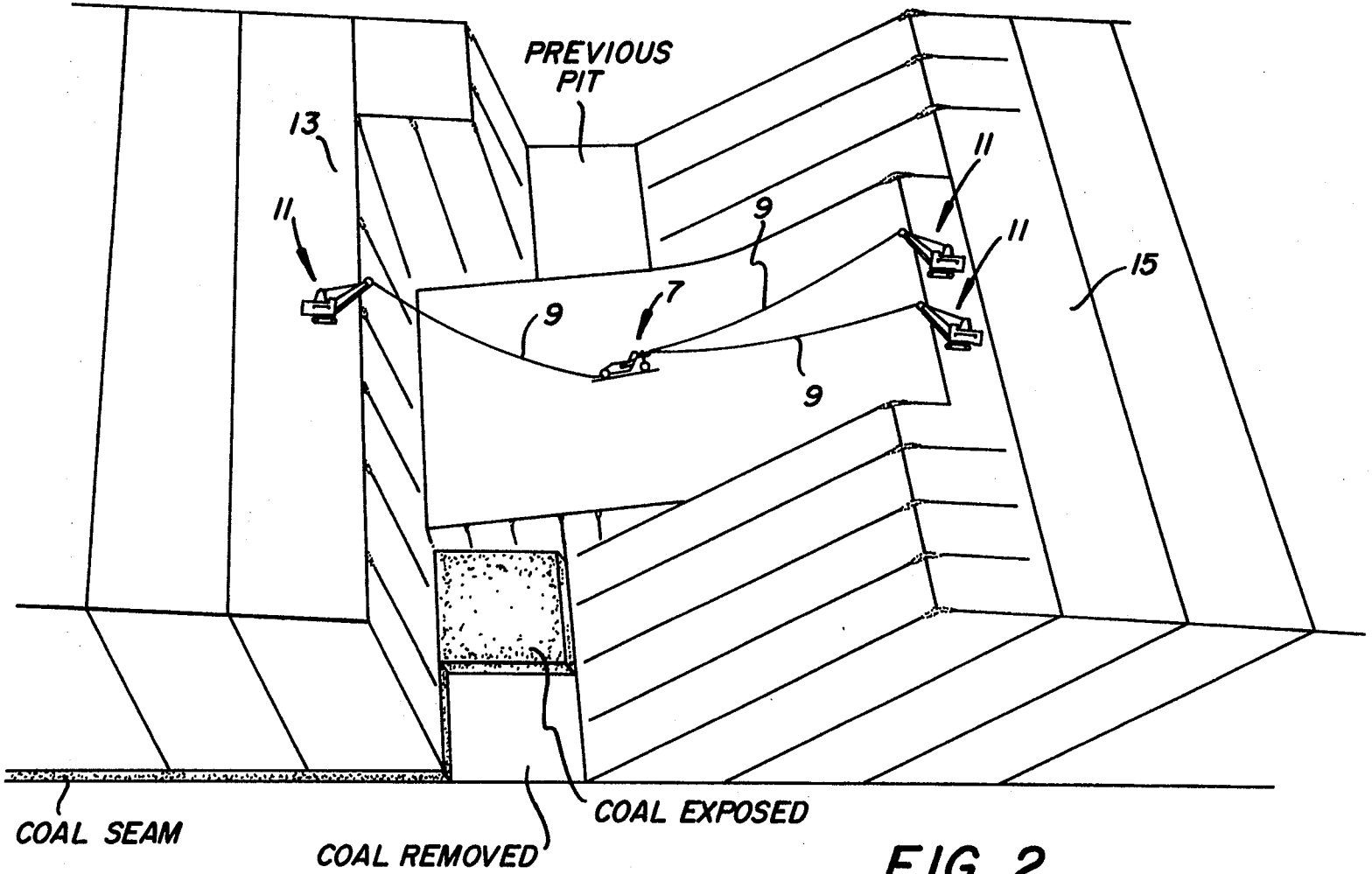
FIG. 2 is a schematic view of another embodiment of an apparatus in accordance with the present invention arranged to remove overburden that covers a valuable mineral or coal deposit in an open-cut mine.

The preferred embodiment of the apparatus shown in FIG. 2 is similar to that shown in FIG. 1, and the main differences are that the winch assemblies 17 are mounted on the anchoring points 11 rather than on the cross-pit vehicle 7 and there is no requirement for the power cable 21 or its associated cable tower 19. The relatively small power requirements for controlling the variable characteristics of the cross-pit vehicle 7 can be supplied by a suitable on-board internal combustion engine.

With reference to FIG. 2, the apparatus comprises a cross-pit vehicle 7, two crawler mounted winch assemblies 11 on the low wall side 15, each separately connected by cables 9 to a forward end of the cross-pit vehicle 7, and a crawler mounted winch assembly 11 on the high wall side 13 connected by a cable 9 to a rearward end of the cross-pit vehicle 7.

Figure 3:
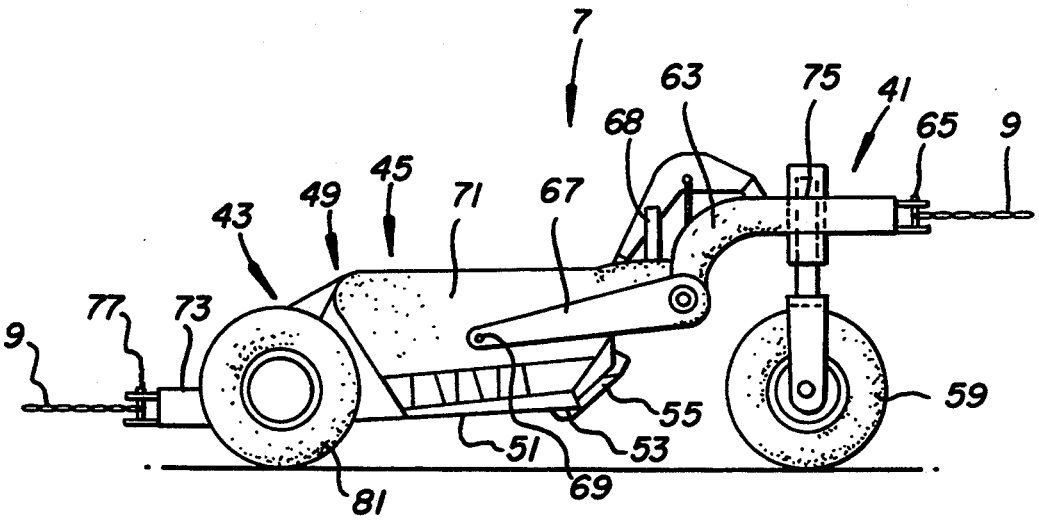
FIG. 3 is a side elevation of one embodiment of a cross-pit vehicle for the apparatus shown in FIG. 2.
Figure 4:
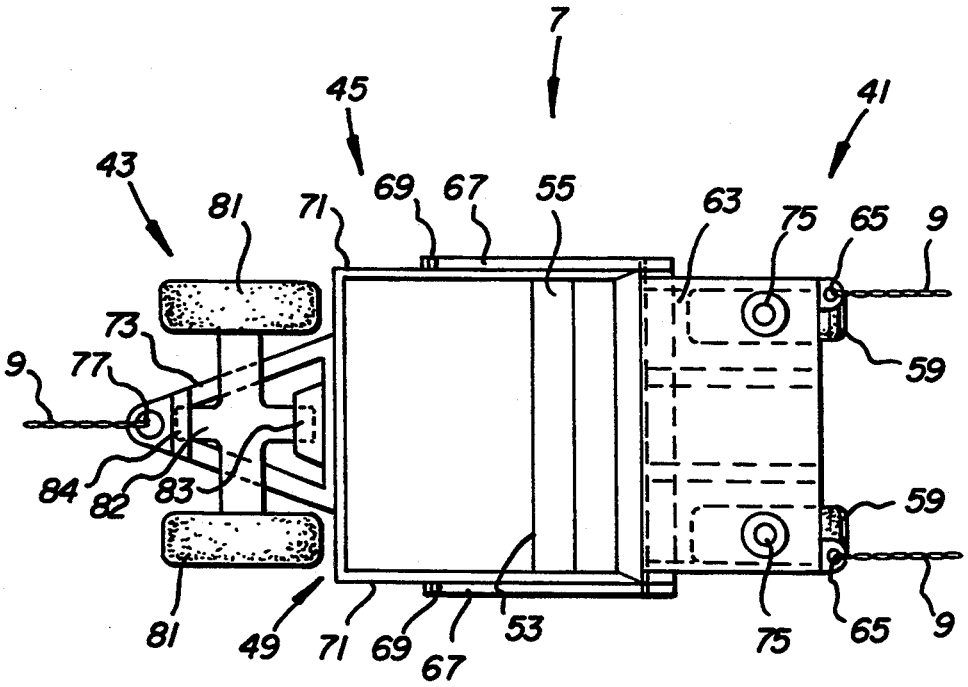
FIG. 4 is a top plan view of the cross-pit vehicle shown in FIG. 3.

With reference to FIGS. 3 and 4, a preferred embodiment of the cross-pit vehicle 7 comprises, a forward wheel assembly 41, a rear wheel assembly 43, and a bowl 45 for receiving and carrying overburden positioned between and coupled to the forward and the rear wheel assemblies 41, 43.

The bowl 45 comprises side walls 71, a rear wall 49, a floor 51 which terminates at a forward end in a cutting edge 53, and a door assembly 55 which is movable between a closed position (shown in FIG. 3) preventing access to the bowl 45 through the forward end thereof and an open position (not shown) allowing access to the bowl 45 through the forward end.

The forward wheel assembly 41 comprises two ground engaging wheels 59 each of which is connected to a support frame 63 by means of a suspension system in the form of a sliding piston/cylinder arrangement 75. The support frame 63 comprises forward hitching points 65 for the cables 9 and arms 67 which extend along both side walls 71 of the bowl 45. The free ends 69 of the side arms 67 are pivotally connected to the side walls 71 of the bowl 45. The arrangement of the forward wheel assembly 41 allows clearance for large rocks to be gathered up by the cutting edge 53 and the bowl 45 and by varying the volume of oil in each of the two cylinders it also allows control of the cross-wise angle of the cutting edge 53 and bowl 45 relative to the cross-slope of the ground being traversed by the front wheels 59.

The rear wheel assembly 43 comprises two ground engaging wheels 81 and crossed beam member 82 which is mounted via trunnion bearings 83 and 84 in a support frame 73 which is connected to the bowl 45. The support frame 73 comprises a rearward hitching point 77 for the cable 9. The arrangement of the rear wheel assembly 43 provides limited freedom for side ways articulation of the rear wheel assembly 43 relative to the bowl 45 of the cross-pit vehicle 7 in order to assist with controlling the crosswise angle of the cutting edge 53 and the bowl 45 relative to the ground traversed by the front wheels 59.

The cross-pit vehicle 7 further comprises hydraulic piston/cylinder assemblies 68 (not fully shown) mounted on the support frame 63 of the forward wheel assembly 41 and connected to the forward end of the bowl 45. The piston/cylinder assemblies 68 control the position of the bowl 45, and more particularly the cutting edge 53 of the floor 51 of the bowl 45, relative to the overburden. Specifically, the combined effect of the piston/cylinder assemblies 68 and the pivotal connection between the side arms 67 and the bowl 45 is to allow the cutting edge 53 on the bowl 45 to be movable between:

(a) an operative position in which the cutting edge 53 extends into and displaces the overburden into the bowl 45; and (b) an inoperative position (FIG. 3) in which the bowl 45 is clear of the overburden.

In the operative position, as the cross-pit vehicle 7 is moved in a forward direction towards the low wall side 15, the cutting edge 53 cuts into and displaces overburden from the mine floor into the bowl 45. When the bowl 45 is full the piston/cylinder assemblies are actuated to lift the bowl 45 clear of the overburden and the door assembly 55 is closed to retain the overburden in the bowl 45.

Figure 5:
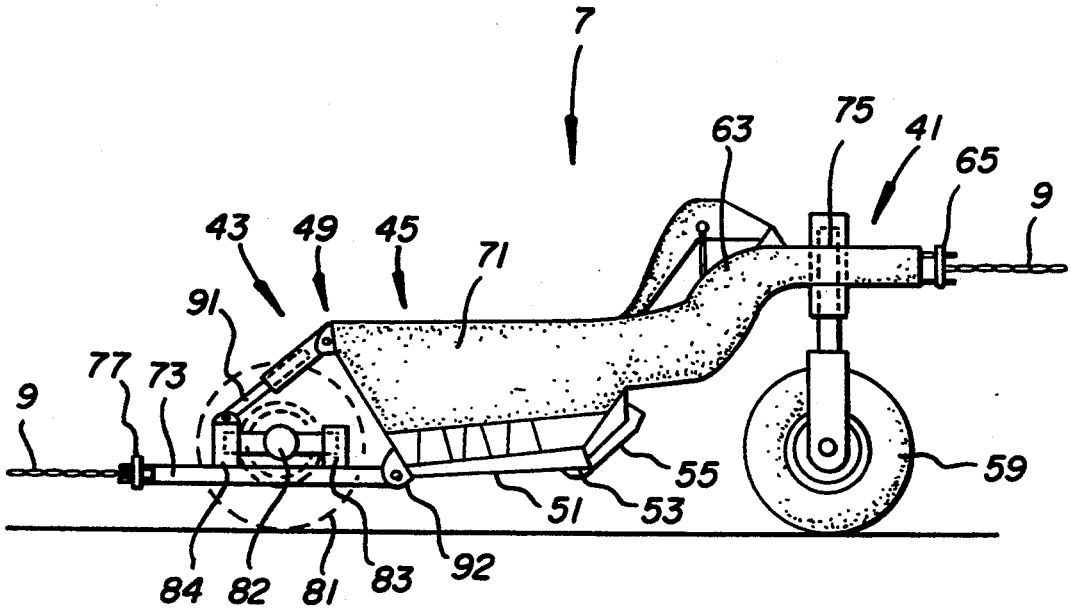
FIG. 5 is a side elevation of another embodiment of a cross-pit vehicle for the apparatus of FIG. 2.

Another preferred embodiment of the cross-pit vehicle is shown in FIG. 5. This embodiment is similar to that of FIGS. 3 and 4 except that the height of the rear end of the bowl 45 is adjustable relative to the rear wheel assembly 43 and that the separate side arms 67 and the associated adjusting cylinders 68 are eliminated.

With the cross-pit vehicle 7 shown in FIG. 5 the position of the cutting edge 53 relative to the ground surface is adjusted by controlling the piston/cylinder arrangements 75 at the front of the cross-pit vehicle 7 and the piston/cylinder arrangement 91 which controls the height of the rear of the cross-pit vehicle 7 relative to the rear wheel assembly 43. In this connection, the support frame 73 is hingedly attached to the rear of the bowl at pivot 92. The advantage of this arrangement is to enable a much stronger and more durable connection between the cables 9 and the cutting edge 53. It also allows the bowl 45 to be in a position where the floor 51 of the bowl 45 is more nearly horizontal when the cutting edge 53 is in the operative position. This reduces the difficulty in making the cut overburden slide up into the bowl 45.

An alternative method of achieving the same function as provided by the arrangement of FIG. 5 could be to support each of the rear wheels 81 of the cross-pit vehicle 7 of FIGS. 3 and 4 independently in the same way as shown for the front wheels 59, that is by a form of the sliding piston/cylinder arrangement 75.

The above described apparatus has a number of advantages over conventional motorised scraper systems, cable pulled hoes and other mining systems, particularly as used for open pit coal mining.

By way of example, the use of the cables 9 connected to anchoring points 11 provides stability and directional control, motive forces and restraining forces that allow the apparatus to operate on slopes that could not be traversed by conventional tractor scrapers. The ability to lift the cutting edge and the entire payload clear of the ground and to carry the payload on wheels greatly reduces the energy usage and increases productivity compared to rope pulled hoes.

Many modifications may be made to the preferred embodiments of the apparatus described with reference to the figures without departing from the spirit and scope of the invention.

We claim:

1. An apparatus for removing overburden or for mining minerals from a valuable deposit on a mine floor comprising:

(a) a cross-pit vehicle adapted to displace overburden and/or minerals from a mine floor as the vehicle traverses said mine floor in a forward travel direction from a first location toward a second location and adapted to carry said displaced overburden and/or minerals toward said second location;

said vehicle comprising:

a cutting edge for dislodging said overburden and/or said minerals from said mine floor as said vehicle moves toward said second location and a means for adjusting the depth of said cutting edge;

(b) at least two spaced apart first anchoring points disposed at said second location, wherein said first anchoring points are movable in a direction which is generally transverse to the direction of movement of said vehicle;

(c) a means to move said first anchoring points;

(d) a least two first cable means, wherein one of said first cable means is connected to one of said first anchoring points and to the cross-pit vehicle, and another of said first cable means is connected to another of said first anchoring points and to the cross-pit vehicle;

(e) a winch assembly means operatively associated with each of said first cable means selectively operable for winding each one of said first cable means to move the cross-pit vehicle in the forward travel direction from said first location toward said second location.

2. The apparatus defined in claim 1 further comprising:

(f) at least one second anchoring point disposed at said first location movable in a direction generally transverse to the forward travel direction of said vehicle;

(g) a second cable means extending from each of said second anchoring points to the cross-pit vehicle;

(h) a winch second assembly means operatively associated with each of said second cable means selectively operable for winding said second cable means to return the cross-pit vehicle when empty in a rearward travel direction from said second location toward said first location.

3. The apparatus defined in claim 2 wherein at least one of said winch assemblies is located on at least one of: the cross-pit vehicle, at least one of said first anchoring points, and the second anchoring point.

4. The apparatus defined in claim 3 wherein at least one of said winch means is mounted on said vehicle, and further comprising:

at least one electrical power cable tower, at least one electrical power cable operatively connecting said electrical power cable tower to said vehicle mounted winch means respectively, and means to supply power to said electrical power cable tower, through said power cable, and thence to said winch.

5. The apparatus defined in claim 4 wherein said tower further comprises a control room containing means to control said apparatus.

6. The apparatus defined in claim 2 wherein said first and second anchoring points are movable in coordination with each other sufficient to reposition said vehicle and said first and second anchoring points such as to move the whole apparatus progressively over an area to be mined.

7. The apparatus defined in claim 2 wherein said second anchoring point comprises two second anchoring points and said second cable means comprises a separate second cable means for each second anchoring point.

8. The apparatus defined in claim 7 wherein said second cable means are attached to said vehicle in a spaced apart relationship with respect to each other.

9. The apparatus defined in claim 1, wherein the first anchoring points are located on a low wall side of an open cut mine.

10. The apparatus defined in claim 9, wherein second at least one anchoring point is located on a high wall side of the open cut mine.

11. The apparatus defined in claim 1, wherein at least one of said anchoring points comprises at least one member selected from the group consisting of purpose designed machines, converted/modified draglines, bulldozers, converted/modified electric rope shovels.

12. The apparatus defined in claim 1, wherein the cross-pit vehicle comprises a wheeled vehicle.

13. The apparatus defined in claim 1 wherein said vehicle comprises a bowl for receiving and carrying material dislodged from the mine floor by the cutting edge, means for moving said bowl between an operative position at which said cutting edge extends into and displaces material on the mine floor into the bowl through a forward portion thereof, and an inoperative position at which the cutting edge is clear of the mine floor and said bowl does not receive material from said mine floor.

14. The apparatus defined in claim 13 further comprising a means inside said bowl for causing said material inside said bowl to be dumped.

15. The apparatus defined in claim 13 wherein said mine floor has a cross slope, further comprising means for controlling the cross wise angle of said cutting edge and said bowl relative to said cross slope of said mine floor.

16. The apparatus defined in claim 1 wherein said first cable means are attached to said vehicle in a spaced apart relationship with respect to each other.

* * * * *